US007216954B2

(12) United States Patent
Kulpa et al.

(10) Patent No.: US 7,216,954 B2
(45) Date of Patent: May 15, 2007

(54) SYSTEM FOR EVAPORATING WASTE INK IN A POSTAGE METER

(75) Inventors: Walter J. Kulpa, Trumbull, CT (US); Norman Barrigas, Danbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 116 days.

(21) Appl. No.: 10/737,448

(22) Filed: Dec. 16, 2003

(65) Prior Publication Data

US 2005/0128244 A1 Jun. 16, 2005

(51) Int. Cl.
*B41J 2/165* (2006.01)

(52) U.S. Cl. ..... 347/35; 347/36; 347/88

(58) Field of Classification Search ..... 347/23–36, 347/88

See application file for complete search history.

(56) References Cited

U.S. PATENT DOCUMENTS

2004/0014006 A1* 1/2004 Garrison et al. ..... 433/149

FOREIGN PATENT DOCUMENTS

| | | | |
|---|---|---|---|
| JP | 57022065 A | * | 2/1982 |
| JP | 01202454 A | * | 8/1989 |
| JP | 04029854 A | * | 1/1992 |
| JP | 05278229 A | * | 10/1993 |

* cited by examiner

*Primary Examiner*—Stephen Meier
*Assistant Examiner*—Ly T. Tran
(74) *Attorney, Agent, or Firm*—George M. Macdonald; Angelo N. Chaclas

(57) ABSTRACT

A postage meter includes a print head, a purge unit for removing waste ink from the print head, an ink tray for receiving the waste ink, and a mechanism for heating the ink tray to promote evaporation of the waste ink.

15 Claims, 4 Drawing Sheets

SYSTEM FOR EVAPORATING WASTE INK IN A POSTAGE METER

BACKGROUND

This invention relates generally to the field of postage meters and is more particularly concerned with handling of waste ink in postage meters.

Postage meters that employ an ink jet printing unit are in widespread use. To maintain printing quality it may be necessary to purge dried or partially dried ink and/or air bubbles from the printing unit. For that reason, it is known to include an ink purge unit in a postage meter that employs ink jet printing. At selected times, the purge unit is engaged with the ink jet printing unit to remove waste ink from the ink jet printing unit. The waste ink is deposited in an absorbent pad.

In the United States, postal regulations require that postage meters be rented, not sold, to aid in maintaining the security of postal funds. It is not unusual for postage meters to come off rental after use by a postal patron for a period of time. The postage meters may then be returned to the manufacturer/owner of the meters for refurbishment, if needed. The returned meters may then be rented to other postal patrons.

During shipment or handling of postage meters to return the meters to the manufacturer/owner, it may occur that the meters may be tipped over, or carried on their sides or upside down. When this occurs, waste ink may drip out of the absorbent pad to foul parts of the postage meter. In some cases the damage to operating parts of the meter, or disfigurement of the appearance of the postage meter, may be so great that it is not cost effective to refurbish and re-rent the postage meter. In these cases the postage meter may need to be scrapped, leading to an increase in over-all cost to the meter manufacturer/owner.

SUMMARY

Accordingly, a system and method are provided to prevent fouling of postage meters from waste ink.

In one aspect, a postage meter includes a print head, a purge unit for removing ink from the print head, an ink tray for receiving ink removed from the print head by the purge unit, and a mechanism for heating the ink tray.

The mechanism for heating the ink tray may include a metal plate for supporting the ink tray and for conducting heat to the ink tray from at least one other component of the postage meter. The at least one other component may include at least one of a power supply and a motor. The metal plate may extend horizontally outwardly from a metal chassis that supports a power supply. The postage meter may include a pad held in the ink tray to absorb ink removed from the print head by the purge unit.

In another aspect, a postage meter includes a print head for printing a postage indicia on a mail piece, a metal chassis that includes a horizontal plate extending from the metal chassis, a transport unit for transporting the mail piece past the print head, a motor mounted on the metal chassis and coupled to the transport unit, a power supply mounted on the metal chassis for supplying power to the motor, a purge unit for removing ink from the print head, and an ink tray resting on the horizontal metal plate. The ink tray is for receiving ink removed from the print head by the purge unit.

In still another aspect, a method of operating a postage meter includes transporting ink from a print head to an ink tray, and heating the ink tray to promote evaporation of the ink in the ink tray.

The heating of the ink tray may include conducting heat to the ink tray from at least one of a power supply and a motor. The ink tray may be supported on a metal plate to which the heat is conducted from the at least one of a power supply and a motor. A metal chassis may conduct the heat to the metal plate from the at least one of a power supply and a motor.

By heating the waste ink tray, whether by use of waste heat from other meter components or by other means, evaporation of the waste ink in the tray may be promoted, so that the viscosity of the waste ink may be increased. Consequently, there may be an increased likelihood that the waste ink may be retained in an absorbent pad in the waste ink tray during shipment and handling of the postage meter. As a result, damage and/or befoulment of the meter by waste ink may be reduced or eliminated and the useful life of the meter may be extended.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

In the postage meter of the present invention, a waste ink tray is heated to promote evaporation of the ink held in the tray. The volume of the waste ink may thus be decreased, and the viscosity of the waste ink may be increased, making it substantially less likely that waste ink will be released from an absorbent pad in the waste ink tray during shipment and handling of the postage meter.

Figure 1:
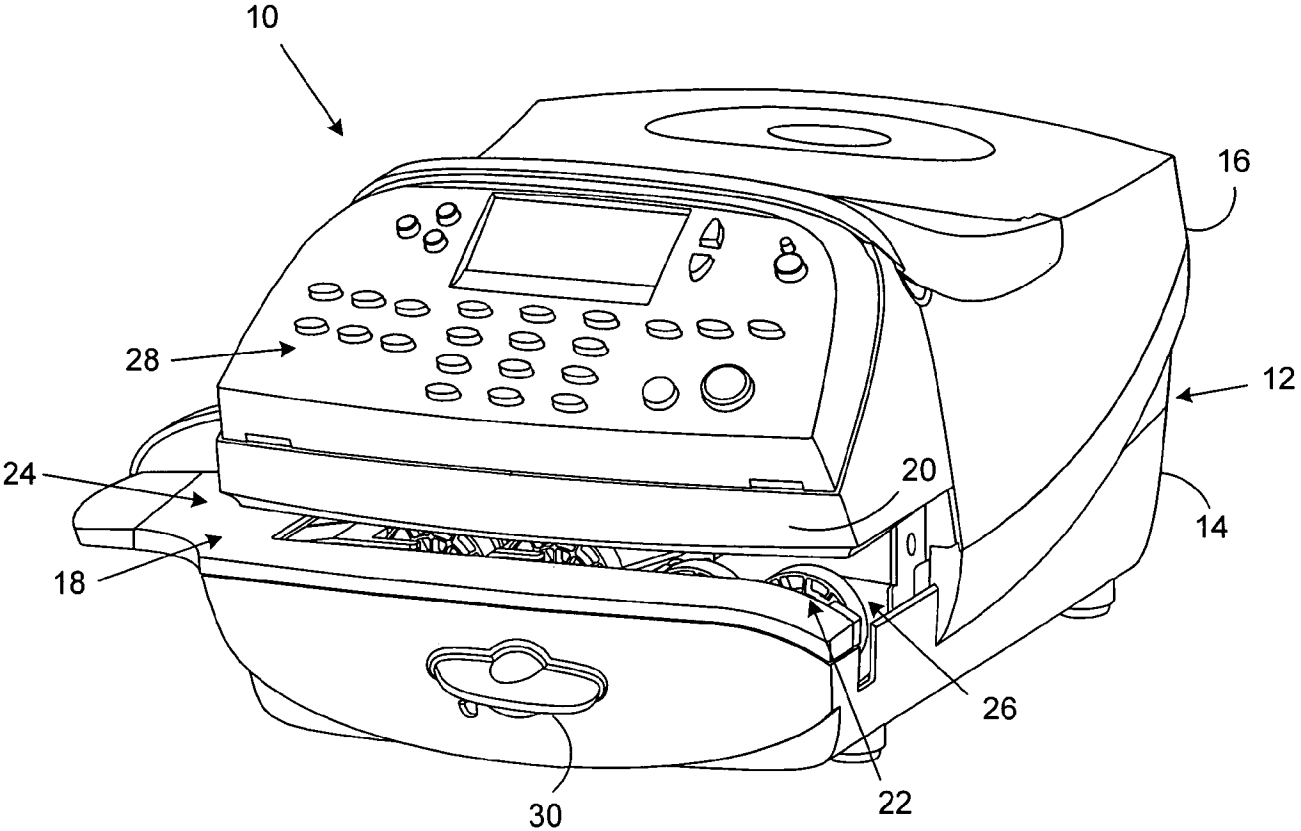
FIG. 1 is an isometric view of a postage meter in accordance with the invention.

Referring now to the drawings, and particularly to FIG. 1, the reference numeral 10 generally indicates a postage meter provided in accordance with the invention.

The postage meter 10 includes a housing 12 formed of a lower case section 14 and an upper case section 16. A slot 18 formed in the front 20 of the housing 12 allows a mail piece (not shown) to be transported through the postage meter 10. The postage meter 10 also includes a transport unit 22 (partially visible through the slot 18) positioned at the slot 18 to transport the mail piece from an infeed side 24 of the slot 18 to an outfeed side 26 of the slot 18. The postage meter 10 further includes a user interface 28 at the front 20 of the housing 12, and a lever 30 positioned below the slot 18 to aid in clearing jams from the transport unit 22.

Figure 2:
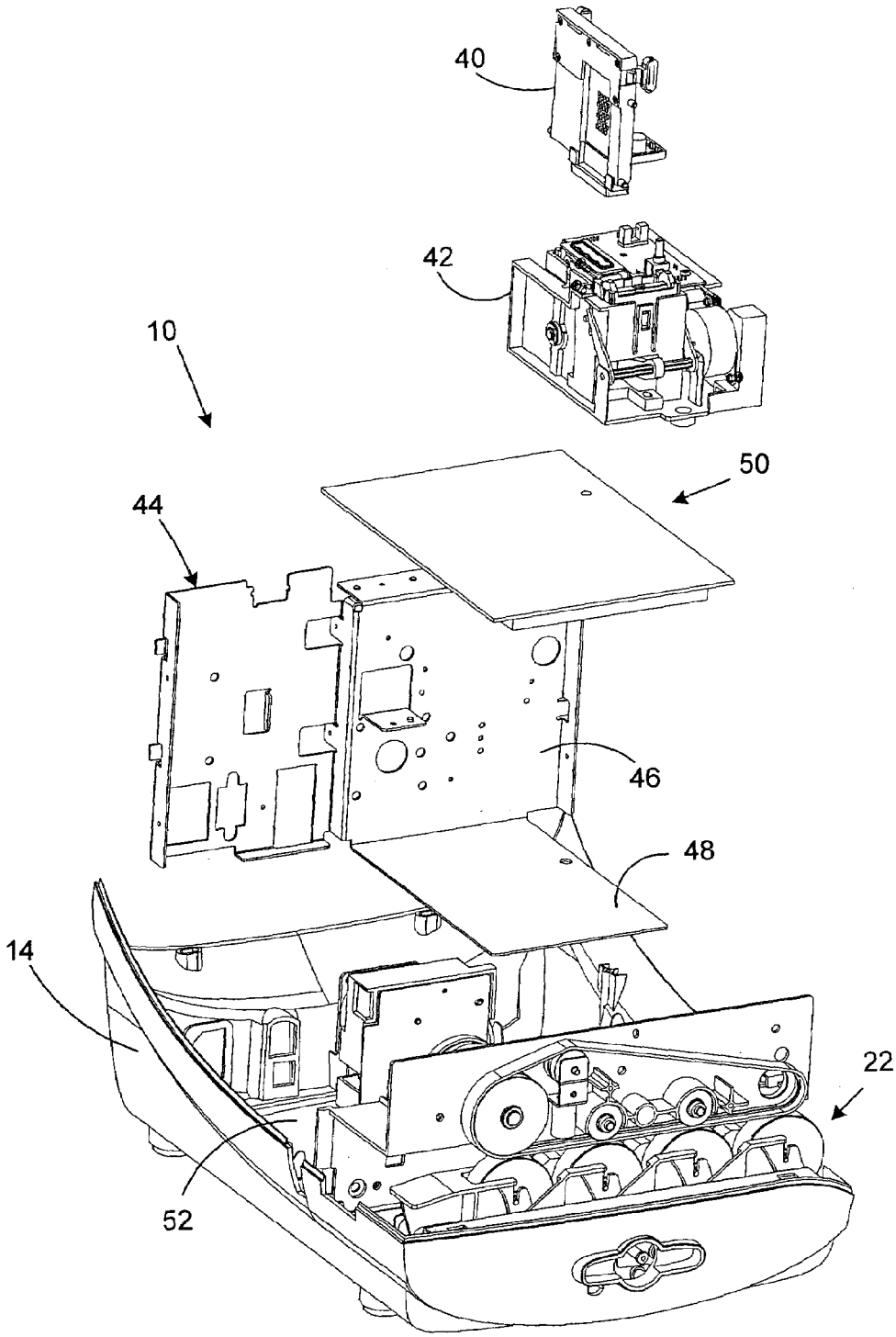
FIG. 2 is a partially exploded view showing some of the internal components of the postage meter of FIG. 1.

FIG. 2 is a partially exploded view showing some of the internal components of the postage meter 10. In addition to the above-mentioned transport unit 22 (which is more clearly visible in FIG. 2), the postage meter 10 includes an ink jet print head 40. In accordance with conventional practices, the transport unit 22 may operate to transport a mail piece (not shown) past the print head 40 so that the print head 40 may print a postage indicia on the mail piece.

The postage meter 10 also includes a waste ink purge unit 42. At appropriate times, the purge unit 42 may come into engagement with the print head 40 to remove excess ink, dried or partially dried ink and/or air bubbles from the print head 40. By a mechanism which is not shown, the print head 40 may be moveable in fore-and-aft directions between a print position adjacent the front of the meter 10 and a purge position that is aft of the print position. When in the print position, the print head 40 may operate to print postage indicia on mail pieces. When in the purge position, the print head 40 may be purged of waste ink by the purge unit 42.

The postage meter 10 further includes a metal chassis 44. The metal chassis 44 includes a vertical section 46 to which certain components (not shown in FIG. 2) of the postage meter 10 may be mounted. The metal chassis 44 also includes a horizontal metal plate 48 which may be integrally formed with at least part of the vertical section 46 of the metal chassis. The metal plate 48 extends horizontally outwardly from the metal chassis 44 in a forward direction.

Also included in the postage meter 10 is a waste ink tray assembly 50. When the postage meter 10 is in an assembled condition (not shown in FIG. 2), the metal chassis 44 may rest on the bottom 52 of the lower case section 14 of the housing 12, with the waste ink tray assembly 50 supported by and resting on the metal plate 48. When the postage meter 10 is in its assembled condition, the waste ink tray assembly 50 is positioned below the purge unit 42 to receive from the purge unit 42 waste ink removed from the print head 40 by the purge unit 42.

Figure 3:
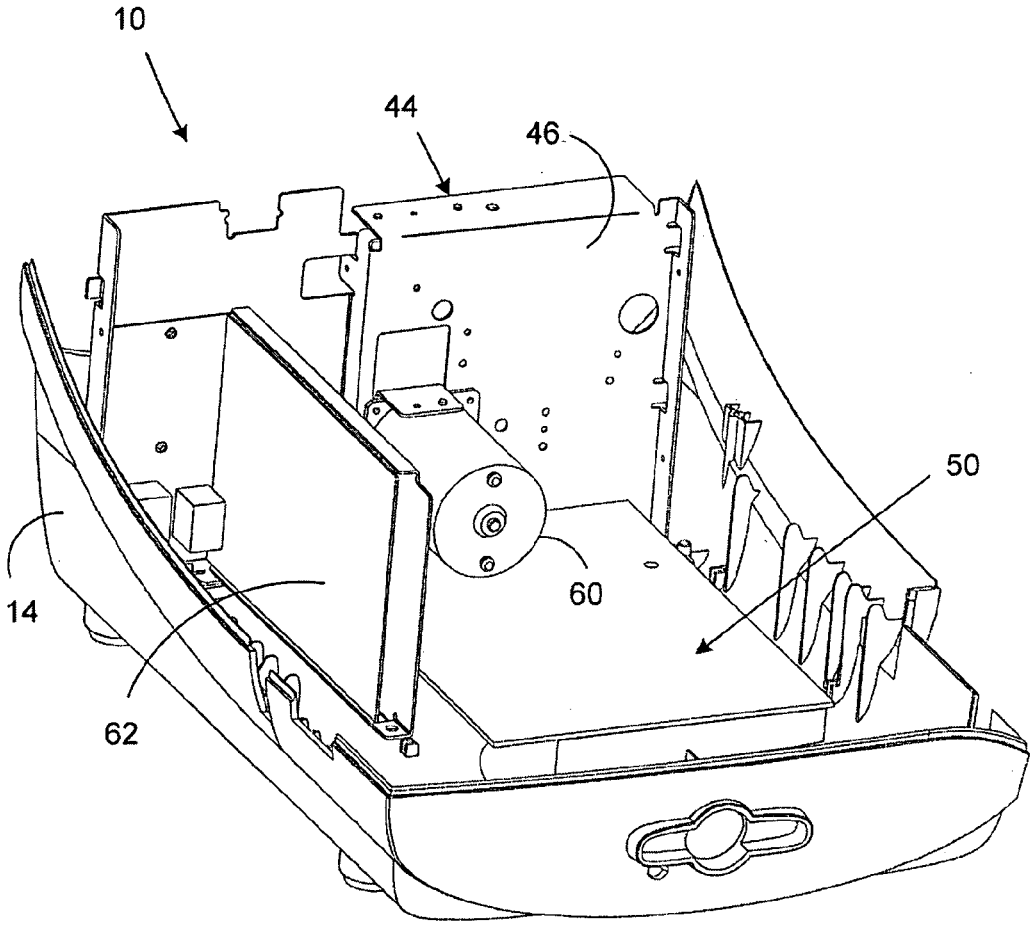
FIG. 3 is an isometric view showing the interior of the postage meter of FIG. 1, with some of its internal components removed.

FIG. 3 is an isometric view showing the interior of the postage meter 10, with some of its internal components removed. For example, the transport unit 22, purge unit 42 and print head 40 shown in FIG. 2 are omitted from FIG. 3 to allow other components to be more readily seen.

As seen from FIG. 3, the postage meter 10 includes a motor 60 mounted on the vertical section 46 of the metal chassis 44 above the waste ink tray assembly 50. A shaft and pulley arrangement, which is not shown, may be provided to couple the motor 60 to the transport unit 22 (FIGS. 1 and 2, not shown in FIG. 3) to allow the motor 60 to drive the transport unit 22 so that the transport unit 22 may transport mail pieces through the slot 18 (FIG. 1) and past the print head 40 (FIG. 2).

The postage meter 10 also includes a power supply 62 mounted on the vertical section 46 of the metal chassis 44 to the right of the motor 60 and the waste ink tray assembly 50. The power supply 62 supplies power to the motor 60 and to other components (not shown in FIG. 3) of the postage meter 10. For example, the power supply may supply power to the purge unit 42. During operation of the postage meter 10, the power supply 62 and/or the motor 60 may generate excess heat, which is conducted through the metal chassis 44 to the metal plate 48 (FIG. 2) on which the waste ink tray assembly 50 rests.

Figure 4:
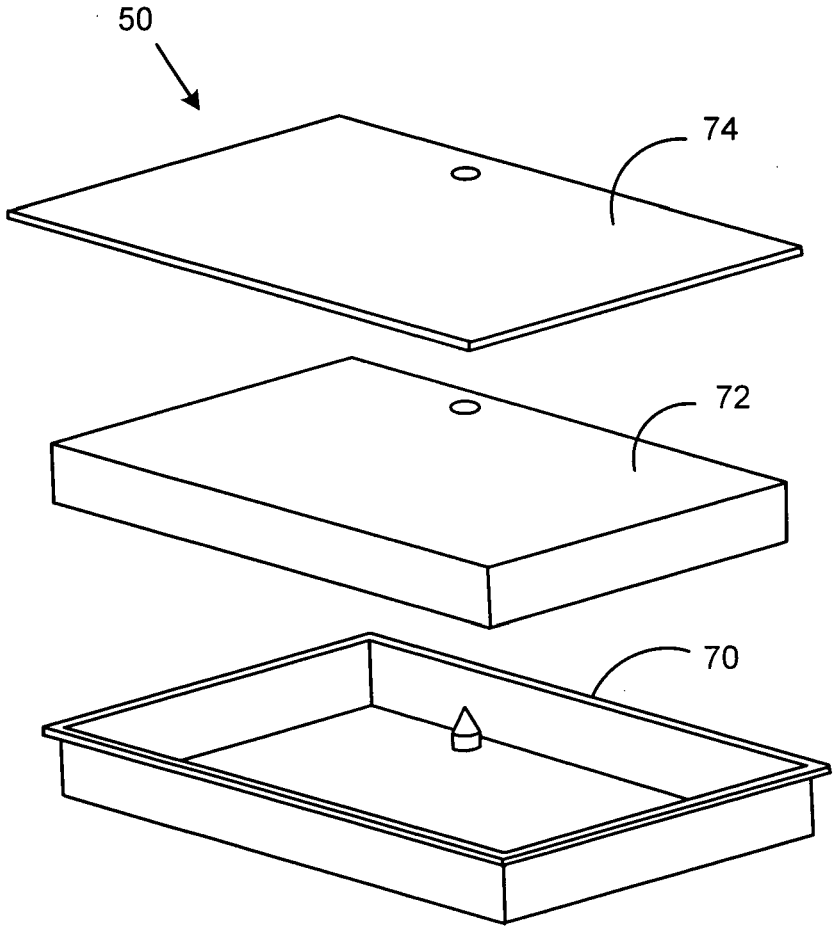
FIG. 4 is an exploded view of a waste ink tray assembly that is shown in FIGS. 2 and 3.

FIG. 4 is an exploded view of the waste ink tray assembly 50. As seen from FIG. 4, the assembly 50 includes an ink tray 70, an absorbent pad 72 (which is held in the ink tray 70 when the assembly 50 is in an assembled condition) and a cover membrane 74. The cover membrane 74 covers the pad 72 and substantially closes the ink tray 70 when the assembly 50 is in the assembled condition. As discussed in co-pending, commonly-assigned patent application Ser. No. 10/737,282, entitled, Ink Jet Printing System For Containment And Evaporation Of Waste Ink, hereby incorporated herein by reference, the cover membrane 74 may be such as to allow vapor to pass therethrough while substantially preventing passage of liquids.

In operation of the postage meter 10, the power supply 62 is energized. Mail pieces are presented seriatim to the infeed side 24 of the slot 18 and are transported by the transport unit 22 (driven by motor 60) through the slot 18 past the print head 40, which prints postage indicia on the mail pieces. The mail pieces are then ejected from the outfeed side 26 of the slot 18.

On appropriate occasions, the print head 40 is moved from its print position (not shown) to its purge position (not shown), to allow the purge unit 42 to engage the print head. By action of one or both of the purge unit 42 and the print head 40, excess ink, dried or partially dried ink and/or air bubbles are removed from the print head 40 by the purge unit 42. The resulting waste ink is transported by the purge unit 42 to the waste ink tray assembly 50 and received by the pad 72 and the ink tray 70.

The power supply 62 and/or the motor 60 generate excess heat, some of which is conducted by the metal chassis 44 to the metal plate 48 and the ink tray 70. The heat conducted to the ink tray 70 by the metal plate 48 causes a modest increase in temperature in the waste ink tray assembly 50 and in the waste ink contained therein. The increase in temperature promotes evaporation of the waste ink. The evaporation of the waste ink reduces the volume of the waste ink, and increases the viscosity of the waste ink.

If it happens that the postage meter is handled or shipped after a period of usage, the decreased volume and increased viscosity of the waste ink in the waste ink tray assembly 50 may tend to prevent the waste ink from escaping from the waste ink tray assembly during shipment and handling. As a result, the postage meter may better tolerate shipment and handling, and may be substantially free of befoulment from waste ink. This may reduce or eliminate the need to refurbish the postage meter prior to re-renting and/or may make it unnecessary to scrap the postage meter due to such befoulment. Consequently, the postage meter may have an increased useful life or may have a lower operating cost and/or greater revenue-generating capacity over its total life cycle. In addition, with improved evaporation of waste ink, it may be feasible to reduce the size of the waste ink tray, thereby saving space in the housing of the postage meter.

In the embodiment illustrated herein, excess heat from the power supply and/or transport motor are conducted by a metal chassis, on which the power supply and motor are mounted, to the waste ink tray assembly via a metal plate extending from the chassis. In addition or alternatively, other mechanisms may be provided to heat the waste ink tray assembly, either with or without use of excess heat from operating components of the postage meter. For example, a thermally conductive foil strip or strips or a heat pipe may be provided to conduct excess heat from the power supply or motor to the waste ink tray assembly. In addition or alternatively, a separate source of heating such as a resistive electrical heating element may be provided adjacent to the waste ink tray assembly to heat the waste ink tray assembly. In other embodiments, the metal plate (if present) upon which the waste ink tray assembly rests may extend directly from the power supply rather than from a portion of the metal chassis that is apart from the power supply.

In some embodiments, the waste ink tray assembly may be modified by, for example, omitting the cover membrane.

The words "comprise," "comprises," "comprising," "include," "including," and "includes" when used in this specification and in the following claims are intended to specify the presence of stated features, elements, integers, components, or steps, but they do not preclude the presence or addition of one or more other features, elements, integers, components, steps, or groups thereof.

A number of embodiments of the present invention have been described. Nevertheless, it will be understood that various modifications may be made without departing from the spirit and scope of the invention. Accordingly, other embodiments are within the scope of the following claims.

What is claimed is:

1. A postage meter comprising:

a print head;

a purge unit for removing ink from the print head;

an ink tray for receiving ink removed, from the print head by the purge unit; and a metal plate for supporting the ink tray connected to at least one other component of the postage meter by a thermal conductor, wherein the thermal conductor passively conducts waste thermal heat energy from the at least one other component of the postage meter to the ink tray continuously during operation of the at least one other component.

2. The postage meter according to claim 1, wherein the thermal conductor includes a metal chassis for supporting the at least one other component of the postage meter and for thermally conducting waste heat to the ink tray from at least one other component of the postage meter.

3. The postage meter according to claim 2, wherein the at least one other component includes at least one of a power supply and a motor.

4. The postage meter according to claim 2, wherein the metal plate extends horizontally outwardly from the metal chassis that supports a power supply.

5. The postage meter according to claim 1, further comprising:

a pad held in the ink tray to absorb the ink removed from the print head by the purge unit.

6. The postage meter according. to claim 1, wherein:

the ink tray is configured for receiving and storing ink removed from the print head by the purge unit.

7. A method of operating a postage meter, comprising the steps of:

transporting ink from a print head to an ink tray; and heating the ink tray to promote evaporation of the ink in the ink tray and to increase the viscosity of the ink;

wherein the heating step includes thermally conducting waste heat to the ink tray from at least one of a power supply and a motor, continuously during operation of the at least one of a power supply and a motor.

8. The method according to claim 7, further comprising the step of:

supporting the ink tray on a metal plate to which the heat is conducted from the at least one of a power supply and a motor.

9. The method according. to claim 8, wherein a metal chassis conducts the heat to the metal plate from the at least one of a power supply and a motor.

10. The method according to claim 7, wherein the ink tray stores. ink transported from the print head to the ink tray.

11. A postage meter comprising:

a print head;

a purge unit for removing ink from the print head;

an ink tray for receiving ink removed from the print head by the purge unit; and means for passively heating the ink tray using waste heat from at least one other component of the postage meter continuously during operation of the at least one other component to promote evaporation of the ink in the ink tray and to increase the viscosity of the ink, wherein the at least one other component includes at least one of a power supply and a motor.

12. The postage meter according to claim 11, wherein the means for passively heating the ink tray includes, a metal plate for supporting the ink tray and for thermally conducting waste heat to the ink tray from at least one other component of the postage meter.

13. The postage meter according to claim 12, wherein the metal plate extends horizontally outwardly from a metal chassis that supports a power supply.

14. The postage meter according to claim 11, further comprising:

a pad held in the ink tray to absorb the ink removed from the print head by the purge unit.

15. The postage meter according to claim 11, wherein:

the ink tray is configured for receiving and storing ink removed from the print head by the purge unit.

* * * * *